US007537507B2

(12) United States Patent
Volynsky

(10) Patent No.: US 7,537,507 B2
(45) Date of Patent: May 26, 2009

(54) HIGH-VOLUME INSERTS FOR FLEXIBLE DOLLS

(75) Inventor: Isaak Volynsky, Beverly Hills, CA (US)

(73) Assignee: Mattel, Inc., El Segundo, CA (US)

( * ) Notice: Subject to any disclaimer, the term of this patent is extended or adjusted under 35 U.S.C. 154(b) by 367 days.

(21) Appl. No.: 10/663,039

(22) Filed: Sep. 15, 2003

(65) Prior Publication Data

US 2004/0092202 A1 May 13, 2004

Related U.S. Application Data

(60) Provisional application No. 60/410,598, filed on Sep. 13, 2002.

(51) Int. Cl.
*A63H 3/36* (2006.01)
*A63H 3/46* (2006.01)

(52) U.S. Cl. ..... 446/376; 446/373; 446/382

(58) Field of Classification Search ..... 446/370, 446/390, 354, 373, 375, 376–383, 330
See application file for complete search history.

(56) References Cited

U.S. PATENT DOCUMENTS

| | | | | | |
|---|---|---|---|---|---|
| 186,919 | A | * | 2/1877 | Atwood | 446/376 |
| 280,986 | A | | 7/1883 | Wishard | |
| 1,189,585 | A | | 7/1916 | Kruse | |
| 1,551,250 | A | | 8/1925 | Henry | |
| 1,590,898 | A | | 6/1926 | McAuley | |
| 2,017,023 | A | | 10/1935 | Rendle | |
| 2,073,723 | A | | 3/1937 | Woolnough | |
| 2,109,422 | A | | 2/1938 | Haughton | |
| 2,129,421 | A | * | 9/1938 | Hales | 446/375 |
| 2,174,932 | A | * | 10/1939 | Weis et al. | 446/378 |
| 2,392,024 | A | | 1/1946 | Couri | |
| 2,601,740 | A | | 7/1952 | Schippert | |
| 2,684,503 | A | | 7/1954 | Silver | |
| 3,277,601 | A | * | 10/1966 | Ryan | 446/378 |
| 3,284,947 | A | * | 11/1966 | Dahl | 446/374 |
| 3,325,939 | A | | 6/1967 | Ryan et al. | |
| 3,350,812 | A | * | 11/1967 | Lindsay et al. | 446/383 |

(Continued)

FOREIGN PATENT DOCUMENTS

GB 2354181 3/2001

(Continued)

OTHER PUBLICATIONS

Photograph of the leg insert used in the GI Joe Action Soldier 1994 Commemorative Edition.

(Continued)

*Primary Examiner*—Gene Kim
*Assistant Examiner*—Alyssa M Hylinski
(74) *Attorney, Agent, or Firm*—Kolisch Hartwell, P.C.

(57) ABSTRACT

A high-volume structural insert for an inner skeleton of an injection molded toy figure. The insert includes a body portion that occupies at least approximately 50% of the volume of an associated portion of the toy figure. The insert also may be provided with at least one engagement portion for engaging another portion of the inner skeleton. The insert may be unitarily or modularly constructed, and in some embodiments the insert may be substantially hollow.

24 Claims, 4 Drawing Sheets

U.S. PATENT DOCUMENTS

| | | | | | |
|---|---|---|---|---|---|
| 3,394,490 | A | * | 7/1968 | Baxter | 446/375 |
| 3,395,484 | A | | 8/1968 | Smith | |
| 3,609,911 | A | * | 10/1971 | Hanf | 446/376 |
| 3,624,691 | A | | 11/1971 | Robson et al. | |
| 3,628,282 | A | | 12/1971 | Johnson et al. | |
| 3,682,282 | A | | 8/1972 | Carboni et al. | |
| 3,716,942 | A | | 2/1973 | Garcia et al. | |
| 3,955,309 | A | | 5/1976 | Noble | |
| 4,123,872 | A | | 11/1978 | Silva | |
| 4,136,484 | A | | 1/1979 | Abrams | |
| 4,233,775 | A | | 11/1980 | Neufeld | |
| 4,470,784 | A | * | 9/1984 | Piotrovsky | 425/116 |
| 4,932,919 | A | | 6/1990 | Shapero | |
| 4,954,118 | A | | 9/1990 | Refabert | |
| 4,964,836 | A | | 10/1990 | Kamei | |
| 5,017,173 | A | * | 5/1991 | Shapero et al. | 446/374 |
| 5,257,873 | A | * | 11/1993 | Abbat | 403/59 |
| 5,516,314 | A | | 5/1996 | Anderson | |
| 5,630,745 | A | | 5/1997 | Yeh | |
| 5,762,531 | A | | 6/1998 | Witkin | |
| 5,800,242 | A | | 9/1998 | Clokey | |
| 5,800,243 | A | | 9/1998 | Berman | |
| 5,989,658 | A | * | 11/1999 | Miura et al. | 428/33 |
| 6,074,270 | A | | 6/2000 | Wilcox et al. | |
| 6,126,509 | A | * | 10/2000 | Berman | 446/418 |
| 6,155,904 | A | | 12/2000 | Spector | |
| 6,217,406 | B1 | | 4/2001 | Ross | |
| 6,494,763 | B1 | * | 12/2002 | Hastey | 446/376 |
| 6,790,398 | B1 | * | 9/2004 | Ejima et al. | 264/251 |
| 6,830,497 | B1 | * | 12/2004 | Lee et al. | 446/376 |

FOREIGN PATENT DOCUMENTS

| | | |
|---|---|---|
| JP | 49-18954 | 2/1974 |
| JP | 49-18955 | 2/1974 |
| JP | 49-18956 | 2/1974 |
| JP | 51-68772 | 6/1976 |
| JP | 60-97067 | 5/1985 |
| JP | 61-94090 | 5/1986 |
| JP | 61-94091 | 5/1986 |
| JP | 61169217 | 7/1986 |
| JP | 61-200581 | 9/1986 |
| JP | 62-53686 | 3/1987 |
| JP | 62-164092 | 7/1987 |
| JP | 63-103685 | 7/1988 |
| JP | 11-212369 | 8/1999 |
| WO | WO0010665 | 3/2000 |
| WO | WO0067869 | 11/2000 |
| WO | WO0108776 | 2/2001 |

OTHER PUBLICATIONS

International Search Report from PCT/US03/29371 dated Mar. 15, 2004.

* cited by examiner

HIGH-VOLUME INSERTS FOR FLEXIBLE DOLLS

CROSS REFERENCE TO RELATED APPLICATIONS

The present application claims priority from U.S. Provisional Patent Application Ser. No. 60/410,598, filed Sep. 13, 2002, incorporated herein by reference in its entirety for all purposes.

FIELD OF THE INVENTION

The present disclosure relates generally to flexible dolls and posable action figure toys. More particularly, it relates to dolls and action figures in which an inner support structure is a rigid plastic armature including a plurality of articulately connected structural inserts, and this armature is encased within an exterior flexible, flesh-like material.

BACKGROUND

Many different varieties of flexible dolls and action figures have been developed over the years, mainly for the purposes of entertainment and display. Creation of a flexible or posable figure generally requires creation of a movable articulated body and limbs, ideally configured to retain whatever pose the figure is placed into. Furthermore, it is often desirable that the figure be posable a large number of times without failure of the structure.

One class of posable figures includes an inner armature or skeleton, possibly including joints to recreate the articulation of a human skeleton, and a molded outer covering or body constructed of a flexible material that surrounds and is bonded or otherwise anchored to the inner skeleton. Examples of such toys are found in U.S. Pat. Nos. 280,986, 1,189,585, 1,551,250, 1,590,898, 2,017,023, 2,073,723, 2,109,422, 2,392,024, 2,601,740, 2,684,503, 3,277,601, 3,325,939, 3,284,947, 3,395,484, 3,624,691, 3,682,282, 3,716,942, 3,955,309, 4,123,872, 4,136,484, 4,233,775, 4,470,784, 4,932,919, 4,954,118, 4,964,836, 5,017,173, 5,516,314, 5,630,745, 5,762,531, 5,800,242, 5,800,243, 5,989,658, 6,074,270, 6,155,904, and 6,217,406, and in publications GB 2354181, JP49-18954, JP49-18955, JP49-18956, JP 51-68772, JP60-97067, JP61-94090, JP61-94091, JP61-94092, JP 61-200581, JP62-53686, JP62-164092, JP63-103685, J11-212369, WO0067869, WO0010665, and WO0108776. The disclosures of all of these patents and publications are incorporated herein by reference.

Flexible doll toys and action figure toys, such as those described above, can be produced by first injection-molding fairly rigid skeletal parts, or "inserts," in a first mold. These structural inserts, which may include a plurality of externally protruding locating pins, sprues and the like, are then positioned in a second mold and held in a proper position while a fairly soft, flexible material (such as polyvinyl chloride or the like) is forced into the second mold to encase the insert, resulting in a doll limb or torso. The resiliency of the exterior material may allow the doll limbs to bend in a limited range of flexible movement, simulating the movement of human limbs.

Known prior art inserts occupy only a relatively small fraction of the volume of the surrounding limb. For example, in U.S Pat. No. 3,682,282, a low-volume insert often includes an elongate, substantially flat segment reinforced with one or more thin ridges protruding orthogonally from the flat segment, such that a low-volume insert has a substantially X- or T-shaped cross-section. Inserts generally taper to a smaller cross-section towards one or both ends, and may be attachable to another insert to form a joint or limb, or to form the skeleton of a toy figure.

SUMMARY

A high-volume structural insert is provided for an inner skeleton of an injection molded toy figure. The insert includes a body portion that occupies a relatively large fraction of the volume of an associated portion of the toy figure. For example, the high-volume insert may occupy at least approximately 50% of the volume of a surrounding limb. The insert also may be provided with at least one engagement portion for engaging another portion of the inner skeleton. The insert may be unitarily or modularly constructed, and in some embodiments the insert may be substantially hollow.

DETAILED DESCRIPTION OF THE PREFERRED EMBODIMENT

A high-volume insert, as disclosed herein, preferably has a substantially circular or elliptical cross-section, and approximates the completed shape of a corresponding limb or limb section relatively closely. For example, the diameter of a high-volume insert may be approximately 75% or more of the diameter of the limb. As discussed in greater detail below, this typically corresponds to a cross-sectional area of the insert that is approximately 60% of the cross-sectional area of the limb at the same point, and typically corresponds to a volume of the body of the insert that is approximately 65%-75% of the volume of a corresponding portion of the limb.

A high-volume insert has many possible advantages over a low-volume insert. Increasing the volume of the insert may decrease the amount of exterior soft plastic material used in the corresponding limb. This may be desirable because most soft plastics, including polyvinyl plastisols such as polyvinyl chloride (PVC), are considered less environmentally sound than the rigid plastics that may be used to form an insert. Using high-volume inserts would therefore decrease the amount of PVC and similar materials used in producing flexible doll toys, and would also reduce the amount of PVC waste at the end of toy life. Replacing higher-density PVC with lower-density rigid plastic also may decrease overall toy weight, reducing shipping costs. Moreover, use of a hollow high-volume insert, produced either as a unitary assembly or as a composite assembly of multiple molded parts, would further reduce production cost by requiring less material.

Figures 1, 2, 3, 4, 5:
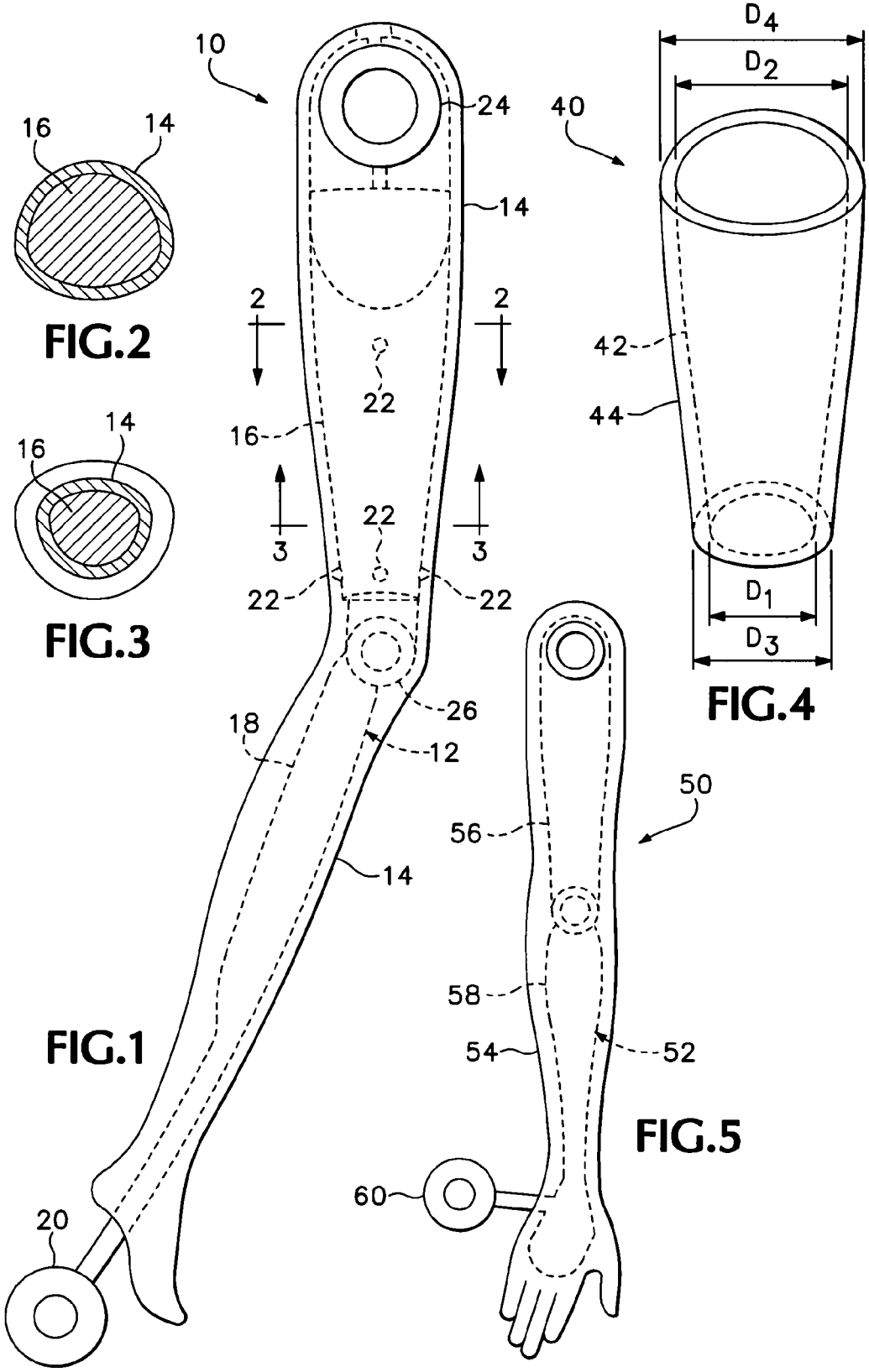
FIG. 1 is a right elevational view of a left doll leg, showing a high-volume insert disposed within a portion of the leg according to an embodiment of the invention.
FIG. 2 is a sectional view taken along the line 2-2 of FIG. 1.
FIG. 3 is a sectional view taken along the line 3-3 of FIG. 1.
FIG. 4 is a perspective view of an upper portion of a doll leg, according to an embodiment of the invention.
FIG. 5 is a right elevational view of a doll arm, showing a high-volume insert disposed within a portion of the arm according to an embodiment of the invention.

FIG. 1 shows a left doll leg 10, viewed from the right side (i.e., from the inner side of the leg). The doll leg includes an inner skeleton 12, and an outer, flesh-like layer 14. An upper leg portion of the skeleton includes a high-volume leg insert 16, according to an embodiment of this disclosure. In contrast, a lower leg portion of the skeleton includes a low-volume leg insert 18. Alternative embodiments, not shown, may include a high-volume insert for the lower leg as well.

In FIG. 1, a locating sprue 20 is shown protruding from the foot of leg 10, and several outwardly protruding stabilization pins 22 extend substantially radially from high-volume insert 16. Sprue 20 and pins 22 may be used for locating skeleton 12 within a mold during a subsequent injection molding process, for example to mold flesh-like layer 14 around the skeleton. Insert 16 also may include one or more engagement portions for engaging other components of the inner skeleton. For instance, a cylindrical boss 24 may be configured to engage a hip joint of the toy figure, and a pivot connection 26 may be configured to engage lower leg insert 18. Further details of the structure of high-volume insert 16 are provided below.

Flesh-like layer 14 of leg 10 may be made of any suitable resilient, flexible material. Typically, the material of layer 14 may have a Shore hardness in the approximate range of 50-80. In the depicted embodiment, for example, the flesh-like layer has a Shore hardness of approximately 65, and is a PVC material. Normally, flesh-like layer 14 would be colored to match the desired finished color of the fully assembled toy. However, layer 14 is depicted as transparent in FIG. 1, so that inner skeleton 12 may be seen within the leg. Inner skeleton 12 may be formed from a hard plastic material, typically a polymer resin material such as polypropylene or polyethylene.

FIG. 2 is a sectional view of leg 10, taken along the line 2-2 in FIG. 1. As indicated in FIG. 2, high-volume insert 16 may be configured to substantially conform to the outer surface of a corresponding portion of the doll leg, and may lie just beneath the surface. In other words, the insert may be configured to span a relatively large percentage of the cross-sectional area of the leg, with flesh-like layer 14 surrounding the insert in a relatively thin layer. Similarly, FIG. 3 is a sectional view of leg 10, taken along the line 3-3 in FIG. 1. This view indicates that insert 16 may taper along the length of the leg, to substantially conform to the taper of the outer surface of the leg.

As mentioned above, high-volume inserts, such as insert 16 shown in FIGS. 1-3, typically may be shaped to match an outer surface of a limb or other doll portion occupied by the insert. In the case of human dolls, portions of the insert may thus be substantially frustoconical (i.e., shaped as a frustum of a cone), with a circular, elliptical, or oblong cross-sectional shape, among others. For example, FIG. 4 shows a frustoconical upper leg portion 40 of a doll, including a frustoconical body portion 42 of a high-volume insert surrounded by a frustoconical outer flesh-like layer 44. In FIG. 4, the doll's leg has been cut to show only the portion of the leg that includes body portion 42 of the high-volume insert. However, it should be appreciated that in general, a high-volume insert may be unitarily formed to include various interface portions connected to the body portion for attaching the insert to other portions of a doll's inner skeleton (see FIGS. 6-14).

For simplicity, FIG. 4 depicts both body portion 42 and outer layer 44 as having substantially circular cross-sections. However, as mentioned above, in general the shape of the insert and limb may vary widely, and may be configured to emulate the natural cross-section of a human limb. In the leg section depicted in FIG. 4, body portion 42 of the insert has minimum diameter $D_1$ and maximum diameter $D_2$, and upper leg portion 40 (including both body portion 42 and outer layer 44) has minimum diameter $D_3$ and maximum diameter $D_4$.

Still referring to FIG. 4, possible dimensions of body portion 42 and upper leg portion 40 are set forth in Table 1 below. The first column of the table includes exemplary minimum and maximum diameters and cross-sectional areas of the body portion of the high-volume insert, as well a corresponding volume of the body portion. Similarly, the second column of the table includes exemplary minimum and maximum diameters and cross-sectional areas of corresponding upper leg portion 40 (including both body portion 42 and outer layer 44), and a corresponding volume of leg portion 40. As indicated in FIG. 4 and described above, $D_1$ and $D_2$ refer to the minimum and maximum diameters, respectively, of body portion 42, and $D_3$ and $D_4$ refer to the minimum and maximum diameters, respectively, of upper leg portion 40.

Each diameter $D_1, \ldots D_4$ has an associated cross-sectional area $A_1, \ldots A_4$, found by assuming a circular cross-section for both the insert and the leg, and then calculating the area of a circle of diameter d using the standard formula $A=\pi(d/2)^2$. Volumes $V_{insert}$ and $V_{leg}$ are found by assuming a circular frustoconical shape for both the insert and the leg, and calculating the volume of a circular frustocone of length L, minimum diameter $d_1$, and maximum diameter $d_2$ using the standard formula:

$$V = \frac{\pi L}{3}\left[\left(\frac{d_1}{2}\right)^2 + \left(\frac{d_2}{2}\right)^2 + \frac{d_1 d_2}{4}\right].$$

The third column of Table 1 expresses the dimensions of body portion 42 of the high-volume insert as a decimal fraction of the dimensions of upper leg portion 40. Note that the fraction $f_v$ of the volume of the leg occupied by body portion 42 may be estimated as:

$$f_V = \frac{V_{insert}}{V_{layer}} = \frac{\frac{\pi L}{3}\left\{\left(\frac{D_1}{2}\right)^2 + \left(\frac{D_2}{2}\right)^2 + \frac{D_1 D_2}{4}\right\}}{\frac{\pi L}{3}\left\{\left(\frac{D_3}{2}\right)^2 + \left(\frac{D_4}{2}\right)^2 + \frac{D_3 D_4}{4}\right\}} = \frac{D_1^2 + D_2^2 + D_1 D_2}{D_3^2 + D_4^2 + D_3 D_4},$$

which is independent of the length L of the leg.

TABLE 1

| | Insert 42 | Upper Leg Portion 40 | Fraction |
|---|---|---|---|
| Minimum diameter | $D_1 = 11.7$ mm | $D_3 = 14.7$ mm | 0.796 |
| Maximum diameter | $D_2 = 21.0$ mm | $D_4 = 24.1$ mm | 0.871 |
| Minimum area | $A_1 = 108$ mm$^2$ | $A_3 = 170$ mm$^2$ | 0.633 |
| Maximum area | $A_2 = 346$ mm$^2$ | $A_4 = 456$ mm$^2$ | 0.759 |
| Volume (L = 49.0 mm) | $V_{insert} = 1.06 \times 10^4$ mm$^3$ | $V_{leg} = 1.48 \times 10^4$ mm$^3$ | 0.715 |

As Table 1 indicates, the high-volume insert may have dimensions that are a substantial fraction of the dimensions of corresponding portions of the leg (or in general of the limb or other appendage) occupied by the insert. Specifically, in the embodiment depicted in FIG. 4, the body portion of the insert may have a diameter that extends at least approximately 75% across a diameter of an associated portion of the leg in which it is disposed. Similarly, the high-volume insert may have a cross-sectional area that occupies at least approximately 60% of the area of the associated portion of the leg, and a volume that occupies at least approximately 60% of the volume of associated portion of the leg.

Although FIGS. 1-4 depict high-volume inserts, and portions thereof, configured to be disposed within a doll's leg, similar inserts may be used in other limbs and/or appendages of a toy figure. For example, FIG. 5 depicts a doll arm 50, including an inner skeleton 52, and an outer, flesh-like layer 54. The inner skeleton includes a high-volume insert 56 in the upper arm, and a lower-volume insert 58 in the lower arm. High-volume insert 56 may be configured to occupy a substantial fraction of the volume of arm 50, and may include features similar to the features of high-volume leg insert 16 described previously, such as a sprue 60 and/or various locating pins (not shown) for stabilizing the insert in a mold. Similarly, other high-volume inserts may be used in other portions of a toy figure, such as the torso, head, and neck portions, among others.

Figure 6:
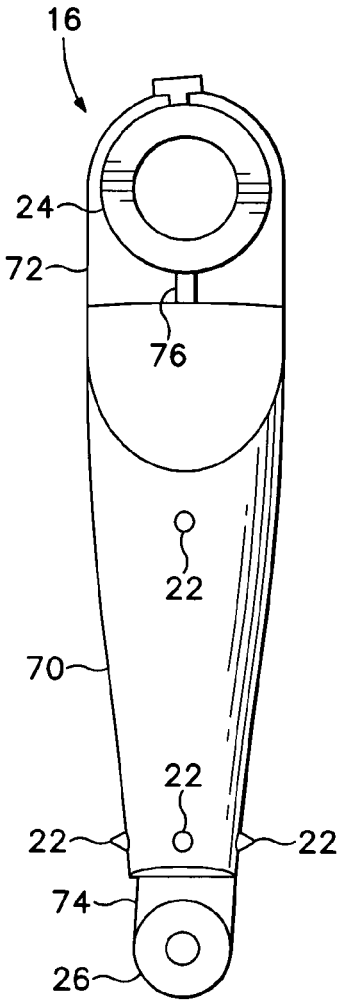
FIG. 6 is a right elevational view showing the high-volume insert of FIG. 1 in isolation.

FIG. 6 shows a close-up view of high-volume leg insert 16 of FIG. 1, viewed from the right (inner) side of the leg. Insert 16 has a body portion 70, a top tab 72, and a bottom tab 74. The body portion may be configured to conform to the shape of an associated portion of a leg, whereas the top and bottom tabs typically are configured to interface with (e.g., attach to) other portions of an inner skeleton of a doll or toy figure. Body portion 70 is roughly frustoconical in shape, tapering from a larger cross-section near top tab 72, to a smaller cross-section near bottom tab 74. Body portion 70 features several outwardly protruding stabilization pins 22, configured to stabilize the insert during molding of a surrounding outer, flesh-like covering. Alternatively, or in addition, various other stabilizing mechanisms such as sprues, apertures, and the like, may be used to stabilize the insert while the flesh-like covering is molded around the skeleton.

In the embodiment of FIG. 6, top tab 72 is a large, substantially flat tab with an arcuate edge, extending upwardly from body portion 70. Hollow cylindrical boss 24 extends outward from top tab 72, and is supported by an upper reinforcement ridge 76. Boss 24 may allow the completed doll leg to be mounted upon a doll torso at a hip joint. Bottom tab 74 is a small, substantially flat tab with an arcuate edge, extending downwardly from body 70 along a plane substantially parallel to top tab 72. Bottom tab 74 includes pivot connection 26, which may be used to facilitate pivotal attachment of insert 16 to another component of an inner doll skeleton, such as a lower leg insert.

Figure 7:
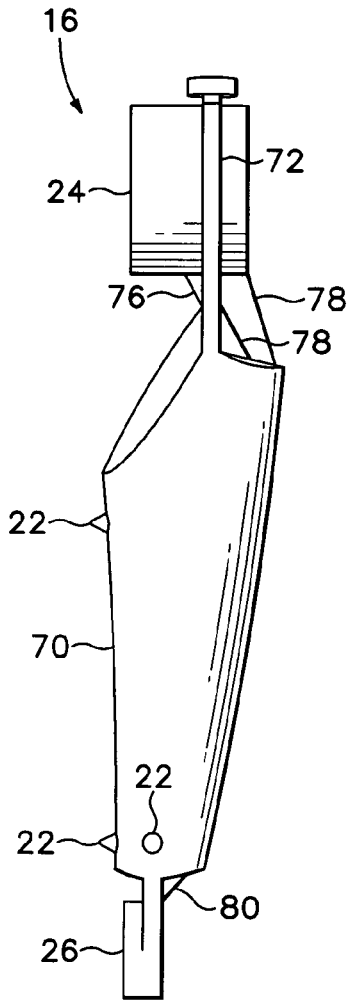
FIG. 7 is a front elevational view of the high-volume insert of FIG. 6.

FIG. 7 depicts insert 16 of FIG. 6, viewed from the front side of the leg. As has been mentioned previously, body portion 70 of insert 16 may be shaped to resemble a human upper leg, as seen from the front. Alternatively, in other embodiments, high-volume inserts may be shaped to resemble other human appendages, animal appendages, and the like. In general, a high-volume insert typically may be shaped to at least partially conform to the outer contour of any toy figure in which it is disposed.

Figure 8:
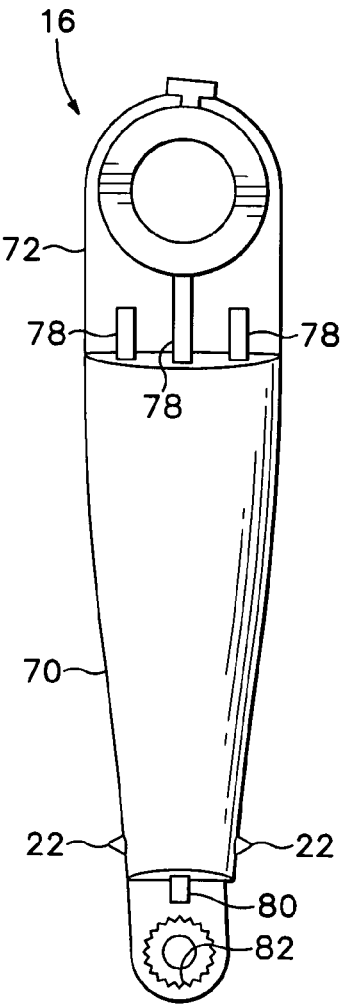
FIG. 8 is a left elevational view of the high-volume insert of FIG. 6.

FIG. 8 depicts insert 16 of FIG. 6, viewed from the left (outer) side of the leg. In the depicted embodiment, three upper reinforcement ridges 78 are provided on the outer side of the insert, which may add structural stability near where top tab 72 meets body portion 70. Bottom tab 74 features a lower reinforcement ridge 80, which similarly may add structural stability near where the bottom tab meets the body portion. Pivot connection 26 may be configured to pivotally engage another component of an inner doll skeleton. In the depicted embodiment, the pivot connection includes a recessed, substantially circular rack 82, configured to engage a lower leg insert to form a flexible knee joint.

Figures 9, 10, 11:
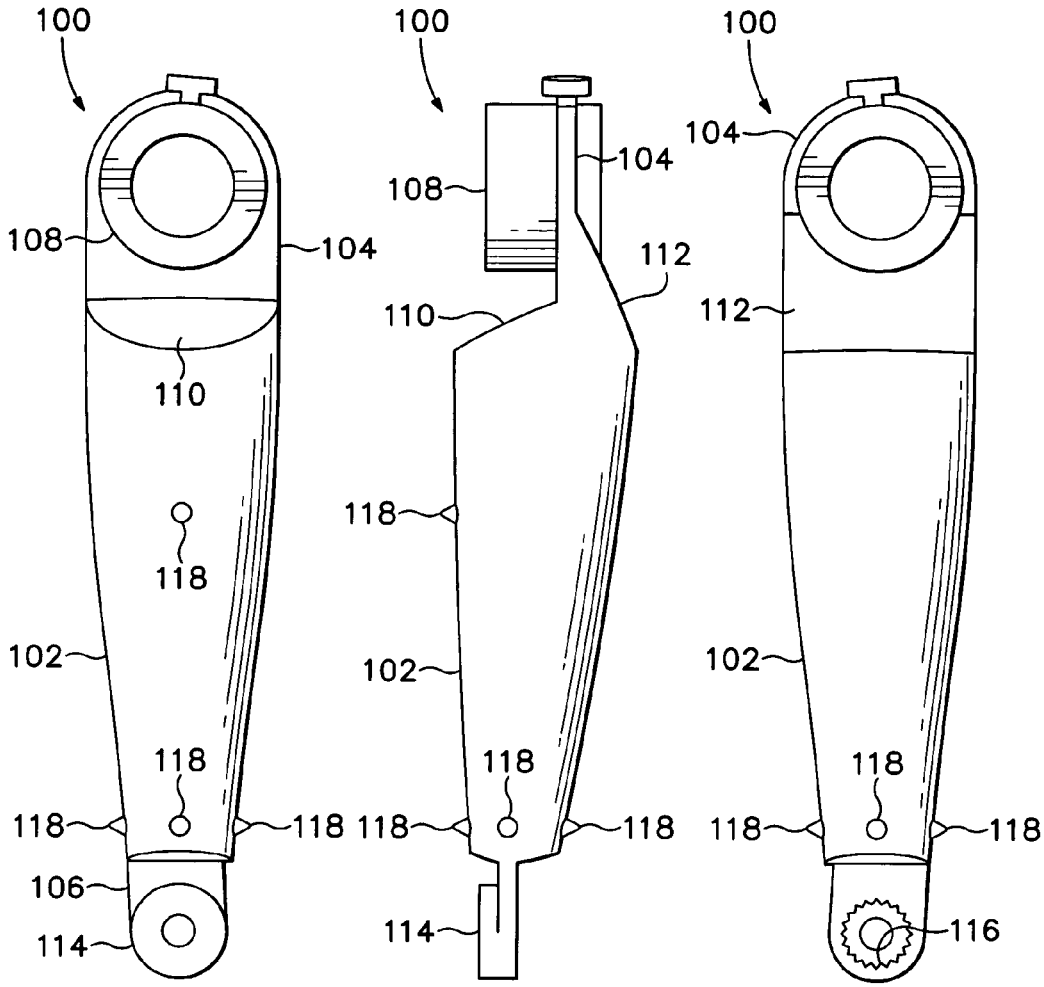
FIG. 9 is a right elevational view of another embodiment of a high-volume insert for a doll leg.
FIG. 10 is a front elevational view of the high-volume insert of FIG. 9.
FIG. 11 is a left elevational view of the high-volume insert of FIG. 9.

FIGS. 9-11 show a high-volume leg insert 100 from the right side, front, and left side, respectively, according to an alternative embodiment of this disclosure. Insert 100 is similar to insert 16 of FIGS. 6-8, including a body portion 102, a top tab 104, and a bottom tab 106. A cylindrical boss 108 extending outward from the top tab may be configured to attach insert 100 to a hip joint of a toy figure. The right side of top tab 104 has a shallow convex surface 110, resulting in a relatively thicker cross-section for stabilizing the cylindrical boss. The left side of top tab 104 stabilizes boss 108 with a solid sloping convex shaft 112. A pivot connection 114 is defined by bottom tab 106, and may include a substantially circular rack 116 configured to engage a lower leg insert. A plurality of stabilization pins 118 are provided on body portion 102, to stabilize the insert during a subsequent molding step.

Figures 12, 13, 14, 15:
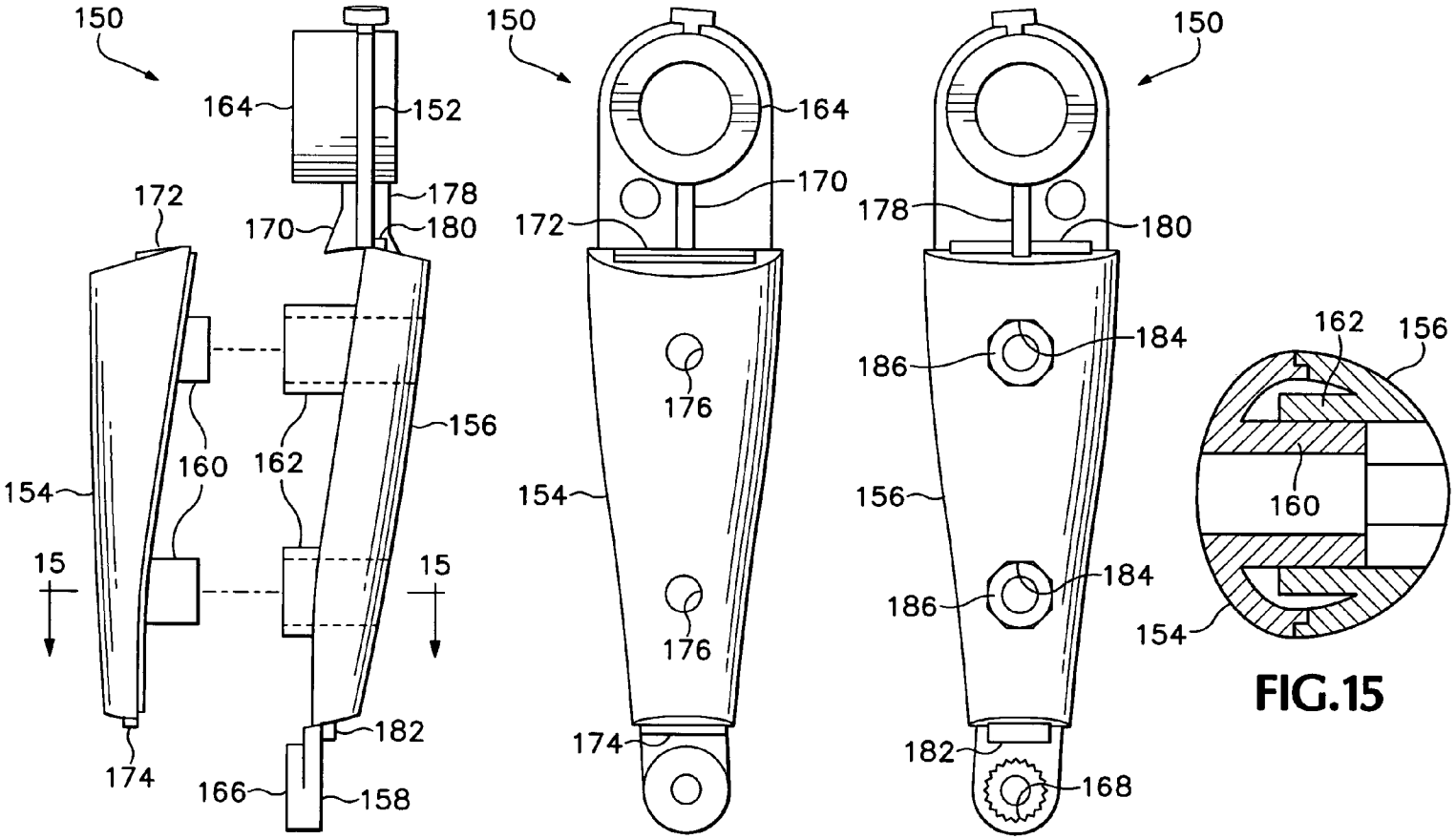
FIG. 12 is a partially exploded front elevational view of yet another embodiment of a high-volume insert for a doll leg.
FIG. 13 is a right elevational view of the high-volume insert of FIG. 12.
FIG. 14 is a left elevational view of the high-volume insert of FIG. 12.
FIG. 15 is a sectional view of the high-volume insert of FIG. 12, taken along the line 15-15.

FIG. 12 shows a partially exploded front view of a hollow, two-piece high-volume leg insert 150, according to yet another embodiment of this disclosure. Insert 150 includes a top tab 152, a first body segment 154, a second body segment 156, and a bottom tab 158. The first and second body segments may be configured to detachably join with each other, for example, by coaxially mating joining dowels 160 of the first segment with substantially hollow interior bosses 162 of the second segment. A hollow, cylindrical boss 164 extends from top tab 152, and a pivot connection 166, possibly including a substantially circular rack 168, is defined by bottom tab 158.

FIG. 13 shows insert 150 of FIG. 12 from the right side, with the two body segments of the insert joined together. The right side of cylindrical boss 164 is supported by an upper reinforcement ridge 170, which rests on first body segment 154 at upper brace 172. Similarly, bottom tab 158 meets first body segment 154 at a lower brace 174. Braces such as braces 172 and 174 may add structural strength and integrity to the high-volume insert, possibly leading to extended life. Apertures 176 in first segment 154 are defined by the interiors of hollow joining dowels 160.

FIG. 14 shows insert 150 of FIG. 12 from the left side, with the two body segments of the insert joined together. The left side of cylindrical boss 164 is supported by a second reinforcement ridge 178, and a second upper brace 180. A lower reinforcement ridge 182 may be provided near the junction of second body segment 156 and bottom tab 158, to reinforce the region where the bottom tab joins with the second body segment. Apertures 184 in second segment 156 are defined by the interiors of interior bosses 162, and may include polygonal counterbores 186. Counterbores 186 may be configured, for example, to facilitate supporting the insert in a mold during a subsequent injection molding step.

FIG. 15 shows a sectional view of insert 150 taken along the line 15-15 of FIG. 13, but with the two body segments of the insert joined together. This views shows in more detail how in this embodiment, joining dowels 160 slide within interior bosses 162 to form insert 150 from segments 154 and 156.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense, because numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

I claim:

1. A high-volume insert for an injection-molded toy figure, comprising:

a hollow body portion substantially frustoconical in shape and configured to form an inner supporting structure for an appendage of the toy figure, the body portion configured to at least partially conform to an outer surface of the appendage and to define a hollow, interior space and to occupy at least 50% of a volume of an associated portion of the appendage, the body portion further including a plurality of stabilization pegs for stabilizing the insert within a mold; and at least one engagement portion configured to engage and form a pivotable connection with another portion of the toy figure, the at least one engagement portion including a substantially planar tab and a cylindrical boss protruding from the tab, the boss supported by a plurality of reinforcement ridges extending between the tab and the body portion and substantially perpendicular to the tab.

2. The high-volume insert of claim 1, wherein the body portion is configured to occupy at least 60% of the volume of the associated portion of the appendage.

3. The high-volume insert of claim 1, wherein the body portion is configured to occupy at least 70% of the volume of the associated portion of the appendage.

4. The high-volume insert of claim 1, wherein a maximum diameter of the insert is configured to extend at least 70% across a diameter of the associated portion of the appendage.

5. The high-volume insert of claim 1, wherein a maximum diameter of the insert is configured to extend at least 75% across a diameter of the associated portion of the appendage.

6. The high-volume insert of claim 1, wherein a portion of the tab has a convex surface for supporting the cylindrical boss.

7. The high-volume insert of claim 1, wherein the at least one engagement portion includes a first engagement portion for engaging a torso portion of the toy figure, and a second engagement portion for engaging a limb portion of the toy figure.

8. The high-volume insert of claim 7, wherein the first and second engagement portions each include a substantially semicircular exterior edge configured to rotate smoothly within an outer covering of the toy figure.

9. A high-volume insert for a skeleton of an injection-molded toy figure, comprising:

a first body segment including one or more support braces; and a second body segment detachably joined with the first body segment to form a body of the insert having a substantially hollow region between the first and second body segments, the body including a plurality of stabilization pegs for stabilizing the insert within a mold, wherein the first body segment includes at least one cylindrical, hollow dowel, and wherein the second body segment includes at least one cylindrical, hollow boss for slidably receiving the dowel to join the body segments, the second body segment further including at least one engagement portion for engaging another portion of the toy figure by forming a pivotable connection, each engagement portion including a substantially planar tab and a cylindrical connector, wherein the connector is supported by reinforcement ridges extending from the tab and configured to engage at least one of the braces.

10. The high-volume insert of claim 9, wherein the body of the insert is configured to occupy at least 50% of a volume of an associated portion of the toy figure.

11. The high-volume insert of claim 9, wherein the body of the insert is configured to occupy at least 60% of a volume of an associated portion of the skeleton.

12. The high-volume insert of claim 9, wherein the body of the insert is configured to occupy at least 70% of a volume of an associated portion of the skeleton.

13. The high-volume insert of claim 9, wherein a maximum diameter of the body of the insert is configured to extend at least 70% across an associated diameter of a limb of the figure.

14. The high-volume insert of claim 9, wherein the at least one engagement portion includes a first engagement portion for engaging a torso portion of the toy figure, and a second engagement portion for engaging a limb portion of the toy figure.

15. An injection-molded toy figure, comprising:

a torso and limbs made of at least one soft flesh-like outer layer molded over an inner skeleton, the inner skeleton including at least one high-volume insert disposed within a limb of the figure, the high-volume insert including:

a hollow body portion configured to occupy at least 50% of a volume of an associated portion of the limb, wherein the body portion remains hollow after the outer layer has been molded over the inner skeleton; and engagement portions at opposing ends of the body portion, each engagement portion for engaging another portion of the inner skeleton, the engagement portions including a cylindrical boss for forming a pivotable connection with another portion of the inner skeleton at a first end and a recessed, substantially circular rack for engaging another portion of the inner skeleton at a second end.

16. The toy figure of claim 15, wherein the body portion of the insert is configured to occupy at least 60% of the volume of the associated portion of the limb.

17. The toy figure of claim 15, wherein the body portion of the insert is configured to occupy at least 70% of the volume of the associated portion of the limb.

18. The toy figure of claim 15, the body portion having a maximum diameter configured to extend at least 60% across a diameter of an association portion of the limb.

19. The toy figure of claim 18, wherein the maximum diameter is configured to extend at least 75% across the diameter of the associated portion of the limb.

20. A high-volume insert for an injection-molded toy figure, comprising:

a hollow body portion substantially frustoconical in shape and configured to form an inner supporting structure for an appendage of the toy figure, wherein a maximum diameter of the body portion is configured to extend at least 70% across a diameter of the associated portion of the appendage; and at least a first engagement portion for engaging a torso portion of the toy figure and a second engagement portion for engaging a limb portion of the toy figure, the first and second engagement portions each including a substantially semicircular edge configured to rotate smoothly within an outer covering of the toy figure, wherein the engagement portions are configured to form a pivotable connection, at least one of the engagement portions including a recessed, substantially circular rack configured to engage the torso or limb portion of the toy figure.

21. The high-volume insert of claim 20, wherein the body portion is configured to occupy at least 50% of the volume of the associated portion of the appendage.

22. The high-volume insert of claim 20, wherein a maximum diameter of the body portion is configured to extend at least 75% across a diameter of the associated portion of the appendage.

23. The high-volume insert of claim 20, wherein the body portion is configured to at least partially conform to an outer surface of the appendage.

24. The high-volume insert of claim 20, wherein the engagement portion includes a cylindrical boss.

* * * * *